US011867019B2

(12) United States Patent
Wright et al.

(10) Patent No.: US 11,867,019 B2
(45) Date of Patent: Jan. 9, 2024

(54) APPARATUS AND METHOD FOR PRESSURE TESTING IN WET SHOE APPLICATIONS

(71) Applicant: WEATHERFORD TECHNOLOGY HOLDINGS, LLC, Houston, TX (US)

(72) Inventors: Craig A. Wright, Houston, TX (US); Zachary S. Trine, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 38 days.

(21) Appl. No.: 17/679,930

(22) Filed: Feb. 24, 2022

(65) Prior Publication Data

US 2023/0265735 A1 Aug. 24, 2023

(51) Int. Cl.
*E21B 33/14* (2006.01)
*E21B 33/12* (2006.01)
*E21B 47/06* (2012.01)

(52) U.S. Cl.
CPC ..... *E21B 33/1208* (2013.01); *E21B 33/14* (2013.01); *E21B 47/06* (2013.01)

(58) Field of Classification Search
CPC ..... E21B 33/1208; E21B 33/14
See application file for complete search history.

(56) References Cited

U.S. PATENT DOCUMENTS 3,948,322 A * 4/1976 Baker ..... E21B 33/127 166/187
4,407,369 A 10/1983 Hutchinson et al.
4,979,562 A 12/1990 Langer
5,762,139 A * 6/1998 Sullaway ..... E21B 33/16 166/291
6,082,451 A 7/2000 Giroux et al.
6,679,336 B2 1/2004 Musselwhite et al.
6,966,368 B2 11/2005 Farquhar
8,127,868 B2 3/2012 Giroux et al.
9,016,388 B2 4/2015 Kellner et al.
9,279,295 B2 3/2016 Williamson et al.
(Continued)

FOREIGN PATENT DOCUMENTS

EP 0753646 A2 1/1997

OTHER PUBLICATIONS

Weatherford. "WLWP Liner Wiper Plug." Liner Systems. 2011 (2 pages).

(Continued)

*Primary Examiner* — Catherine Loikith
(74) *Attorney, Agent, or Firm* — Cabello Hall Zinda, PLLC

(57) ABSTRACT

When cementing tubing in a borehole, a wet shoe track is created, and pressure testing of the tubing is performed. To do this, a wiper plug seats in a seat of an insert disposed in a first position in a flow bore of a tool. The insert is released and moved toward a second position in the flow bore in response to the first pressure applied against the seated wiper plug. A collar disposed on the wiper plug seats on a second seat disposed uphole of the first seat. The tubing is pressure tested by applying pressure down the tubing against the wiper plug with the collar seated in the second seat. Fluid communication is then established through the flow bore downhole of the wiper plug, the first seat, and the second seat by removing the collar from the wiper plug. This can create the wet shoe track.

22 Claims, 4 Drawing Sheets

(56) References Cited

U.S. PATENT DOCUMENTS

| | | | |
|---|---|---|---|
| 9,297,229 | B2 | 3/2016 | Rytlewski |
| 9,441,440 | B2 | 9/2016 | Hofman et al. |
| 9,476,282 | B2 | 10/2016 | Anton et al. |
| 9,719,322 | B2 | 8/2017 | Geogel |
| 9,920,591 | B2 | 3/2018 | Themig |
| 10,260,306 | B1 | 4/2019 | Beckett et al. |
| 10,961,815 | B2 | 3/2021 | Garcia et al. |
| 2014/0116721 | A1 | 5/2014 | Hofman et al. |
| 2014/0224479 | A1 | 8/2014 | Andrigo |
| 2015/0285026 | A1 | 10/2015 | Frazier |
| 2015/0308208 | A1 | 10/2015 | Capps et al. |
| 2016/0145995 | A1 | 5/2016 | Hannegan et al. |
| 2018/0051533 | A1 | 2/2018 | Zbranek et al. |
| 2018/0142528 | A1 | 5/2018 | George et al. |
| 2021/0047898 | A1 | 2/2021 | Garcia et al. |

OTHER PUBLICATIONS

Weatherford. "Dual-Wiper Plug (DWP) with Integral Ball Seat." Liner Systems. 2006-2009 (2 pages).
Weatherford. "WSWP Single-Wiper Plug with Integral Ball Seat." Liner Systems. 2011 (2 pages).
"Casing Wiper Plugs and Darts," Weatherford, 2013, 58 pages.
Int'l Search Report and Written Opinion in PCT Appl. PCT/US2022/052523, dated Mar. 13, 2023, 11—pgs.

* cited by examiner

APPARATUS AND METHOD FOR PRESSURE TESTING IN WET SHOE APPLICATIONS

BACKGROUND OF THE DISCLOSURE

Operators may use a "wet shoe" at the end of tubing, such as casing, liner, or other tubing. In the wet shoe, cement is not set around or does not obstruct a float valve (e.g., a check valve) at the end of the tubing. After cementing, fluid flow remains established through the tubing and the float valve into the well. In this way, the wet shoe enables operators to conduct subsequent operations after cementing, such as pumping down plugs or perforating guns to the toe of the well.

As will be appreciated, the tubing is subject to pressure changes and cycles during its operational life, and the structural integrity of the tubing must be maintained. For this reason, a pressure integrity test is performed on the tubing after cementing, but the presence of the wet shoe complicates the procedure. Typically, operators need to land a ball on a seat downhole or need to set a plug in the tubing so the pressure integrity of the tubing can be checked. As expected, these steps require additional time and resources to complete.

The subject matter of the present disclosure is directed to overcoming, or at least reducing the effects of, one or more of the problems set forth above.

SUMMARY OF THE DISCLOSURE

An assembly disclosed herein is used for cementing tubing in a wellbore with cement and for testing the tubing with applied pressure. The tubing has an uphole seat and a downhole seat. The assembly comprises a plug body having a downhole end and an uphole end and having one or more wipers disposed thereabout. A first portion of the plug body is disposed toward the downhole end of the plug body. The first portion is configured to pass through the uphole seat and is configured to engage with the downhole seat in the tubing. The first portion engaged with the downhole seat is configured to prevent communication of the applied pressure through the downhole seat. A second portion of the plug body is disposed toward the uphole end of the plug body. The second portion is configured to engage with the uphole seat in the tubing, and the second portion engaged with the uphole seat is configured to prevent communication of the applied pressure through the uphole seat. The second portion is removable from the plug body, and the plug body upon removal of the second portion is releasable from the uphole seat and is configured to permit fluid communication through the uphole seat.

The assembly can further comprise a tool disposed on the tubing and defining a flow bore, the flow bore having the uphole seat. The tool can comprise an insert movably disposed in the flow bore, where the insert has the first seat and is held in the flow port by a releasable connection.

An assembly disclosed herein is used for cementing tubing in a wellbore with cement and for testing the tubing with applied pressure. The assembly comprises a tool, an insert, and a wiper plug. The tool is disposed on the tubing and has an uphole end and a downhole end. The tool defines a flow bore therethrough. The insert is disposed in the flow bore and has a first seat. The insert is held in a first position by a releasable connection to the tool. A second seat is disposed in the flow bore of the tool uphole of the insert.

The wiper plug is deployable down the tubing and is configured to engage with the first seat of the insert. The wiper plug engaged with the first seat of the insert in the first position is configured to prevent a first application of the applied pressure through the flow bore. The insert with the engaged wiper plug is movable from the first position in response to the first application of the applied pressure releasing the releasable connection.

A collar is disposed on the wiper plug and is configured to engage with the second seat. The collar engaged with the second seat is configured to prevent a subsequent application of the applied pressure through the flow bore. The collar is removable at least after the subsequent application. The wiper plug upon removal of the collar is configured to release from the second seat, and the insert with the engaged wiper plug is movable to a second position configured to permit fluid communication through the flow bore of the tool.

The assembly can further comprise another plug that is deployable down the tubing behind the wiper plug and that is configured to engage with the wiper plug. Alternatively, the wiper plug can comprise bottom and top members. The bottom member has a passage therethrough, which has a closure closing the passage. The bottom member is deployable down the tubing ahead of the cement and is configured to engage with the first seat of the insert. The closure of the bottom member is opened in response to an initial application of the applied pressure against the seated bottom member before the first application. The top member is configured to engage with the passage of the bottom member and is configured to close fluid communication through the passage in the bottom member.

For this arrangement of the wiper plug, the passage of the bottom member can define a receptacle, and the top member can comprise a drillpipe dart having a head, where the head is configured to engage with the receptacle of the bottom member.

In the assembly, the insert can comprise a sleeve disposed in the flow bore. The sleeve can have a fluid passage therethrough with the first seat formed therein, and the sleeve can define a bypass port communicating the fluid passage downhole of the first seat outside the sleeve.

In the assembly, the flow bore of the tool can define a relief therein. The insert in the second position can be disposed adjacent to the relief and can be configured to permit the fluid communication in a space between the insert and the relief. The relief of the tool can define a shoulder toward the downhole end of the tool, the shoulder engaging the insert in the second position.

In the assembly, the collar can comprise a self-removable material selected from the group consisting of a dissolvable material, an erodible material, a disintegrable material, a degradable material, an aluminum, a reactive metal, a magnesium alloy, a degradable composite polymer, a polystyrene, an elastomer, a resin, an adhesive, a polyester, a polyamide, a thermoplastic polymer, a polyglycolide, a polyglycolic acid, and a thermosetting polymer. The temporary connection can comprise one or more shear pins disposed between the insert and the flow bore of the tool.

A method disclosed herein comprises: cementing tubing in a borehole by: (i) pumping cement down a flow bore of the tubing, (ii) deploying a wiper plug down the flow bore at least behind a portion of the cement, and (iii) seating the wiper plug on a first seat disposed in a first position in the flow bore of the tubing; moving the first seat and the wiper plug from the first position toward a second position in the flow bore with a first application of pressure down the flow bore against the seated wiper plug; pressure testing the tubing by: (i) seating a collar disposed on the wiper plug on a second seat disposed in the flow bore uphole of the first seat, (ii) applying a second application of pressure down the flow bore, and (iii) preventing the second application of pressure through the flow bore downhole of the collar seated in the second seat; and establishing fluid communication through the flow bore downhole of the wiper plug, the first seat, and the second seat by removing the collar from the wiper plug.

To establish the fluid communication through the flow bore downhole of the wiper plug, the first seat, and the second seat, the method can comprise releasing the first seat and the wiper plug to move to the second position in the flow bore, and bypassing the fluid communication through the flow bore around the wiper plug seated in the first seat moved to the second position.

The method can further comprise pressure testing the cemented tubing by: (i) seating a second plug in the second seat in the flow bore uphole of the first seat, (ii) subjecting the cemented tubing to a third application of pressure against the seated second plug, and (ii) reestablishing fluid communication through the flow bore of the tubing by self-removing the second plug from the second seat.

To cement the tubing in the borehole, the method can comprise: seating a bottom member of the wiper plug ahead of the cement on the first seat; breaching a flow passage through the bottom member; passing the cement through the flow passage; and \seating a top member of the wiper plug behind the cement in the flow passage of the bottom member.

To move the first seat from the first position toward the second position in the flow bore with the first application of pressure against the seated wiper plug, the method can comprise releasing a temporary connection retaining the first seat in the first position inside the flow bore with the first application of pressure against the seated wiper plug.

To move the first seat from the first position toward the second position in the flow bore with the first application of pressure against the seated wiper plug, the method can comprise shifting an insert having the first seat from the first position toward a relief of the flow bore in the second position.

To establish the fluid communication through the flow bore downhole of the wiper plug, the first seat, and the second seat, the method can comprise bypassing the fluid communication from the relief of the flow bore through a side port defined in the insert downhole the first seat.

The method can further comprise establishing a wet shoe track downhole of the first seat.

The foregoing summary is not intended to summarize each potential embodiment or every aspect of the present disclosure.

DETAILED DESCRIPTION OF THE DISCLOSURE

Figure 1A:
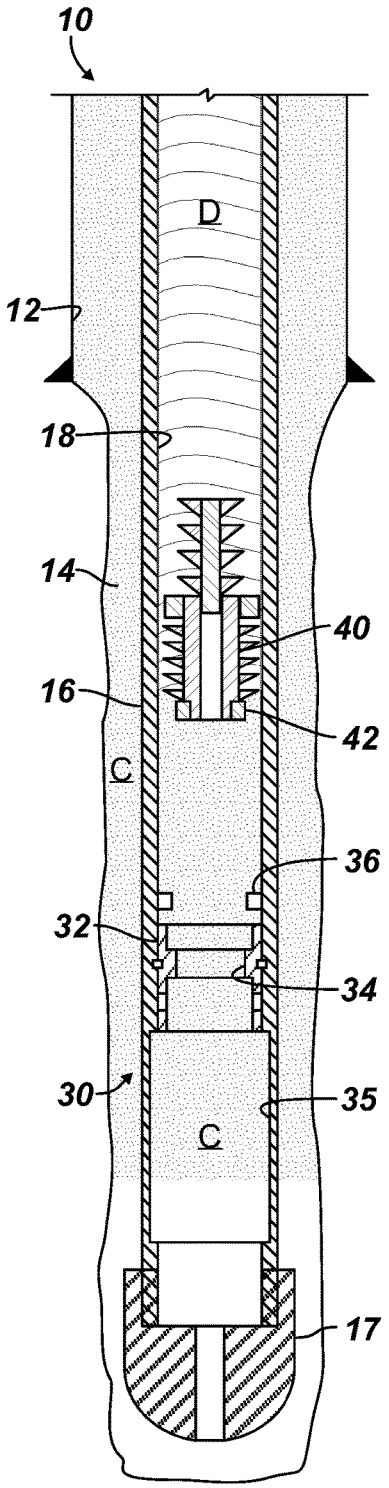
FIGS. 1A-1C illustrate a wet shoe assembly during steps of a cementing procedure according to the present disclosure.
Figure 1B:
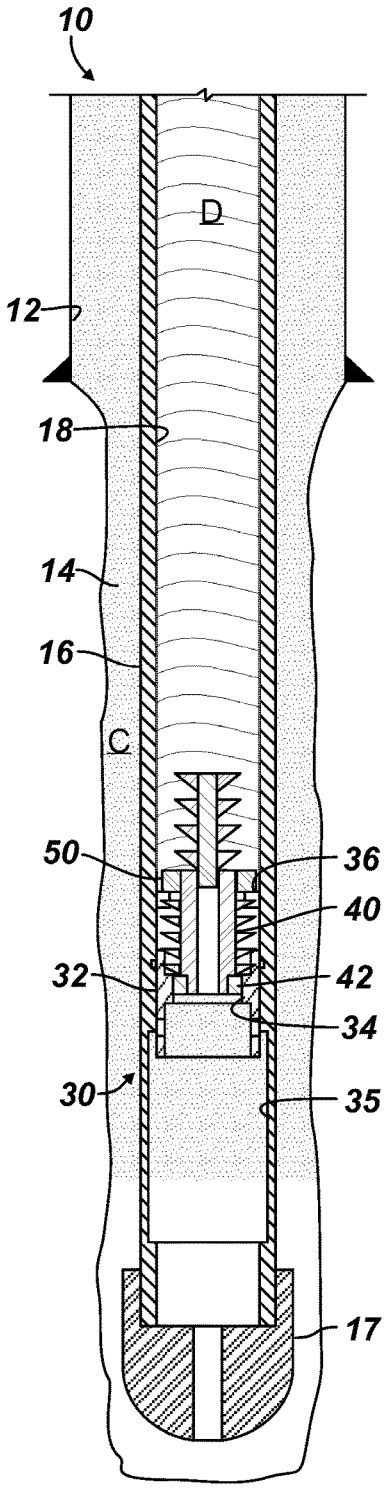
Figure 1C:
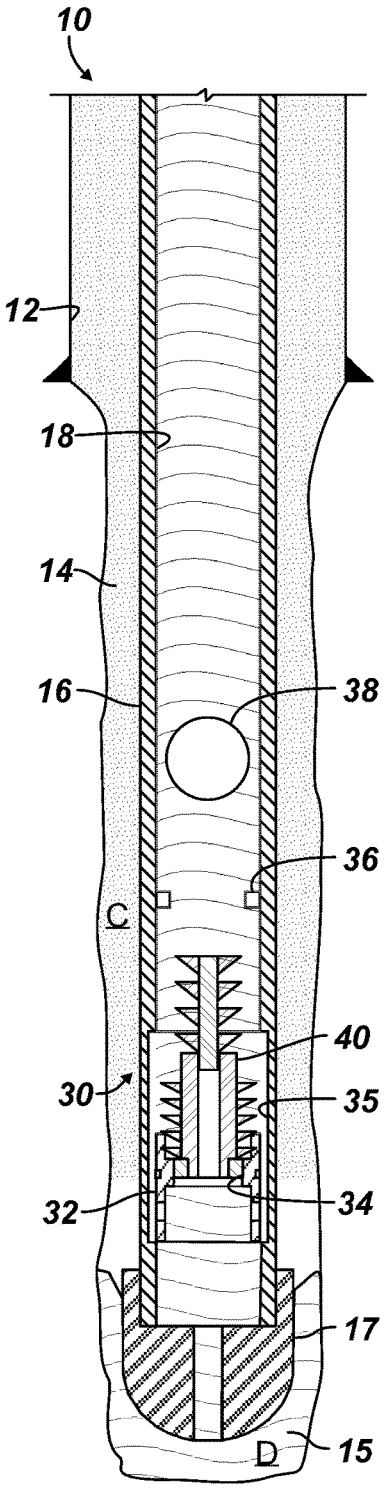

FIGS. 1A-1C illustrate a wet shoe assembly 10 during steps of a cementing procedure according to the present disclosure. Tubing 16 is being cemented in a borehole 12. The tubing 16 referred to herein may be casing, production tubing, liner, tubulars, or the like. A wet shoe tool 30 is disposed on the tubing 16 and can be used with (or can be part of) a casing shoe/landing collar. For example, the wet shoe tool 30 can be disposed above a toe shoe 17, hydraulic landing collar, float equipment, or the like.

The wet shoe tool 30 is used for performing a wet shoe application, which is an operation that opens the flow path through the casing shoe after cementing. The "wet shoe" occurs when cement does not set around the toe shoe 17 so that fluid may continue to flow through the toe shoe 17 after the system is cemented in the borehole 12. During cementing operations, a wiper plug 40 is landed in the wet shoe tool 30. Operators apply pressure to a predetermined level to activate the tool 30 and open an internal bypass so fluid can pass through the tool 30. The opened fluid bypass allows operators to displace the cement and clear the toe shoe 17, leaving a desired wet shoe track.

As shown in FIG. 1A, for example, an initial fluid slug followed by cement C has been pumped down through the tubing bore 18 of the tubing 16, past the wet shoe tool 30, out the toe shoe 17, and into the annulus 14 of the borehole 12. The toe shoe 17 may include a one-way valve or a check valve, such as a float valve/collar, which permits fluid flow out of the tubing 16 and into the borehole 12, while preventing fluid flow into the wet shoe assembly 10 from the borehole 12. The cement may be supplied through a work string (not shown) or the tubing 16 if the work string is removed.

A wiper plug 40 is pumped down the tubing bore 18 of the tubing 16 behind the cement C using a displacement fluid D. The wiper plug 40 is used to wipe the interior of the tubing 16 and keep a separation between the cement C and the displacement fluid D. In some implementations, a volume of fluid for producing a wet shoe may follow the cement C and may be advanced ahead of the wiper plug 40. This wet shoe volume can then be used to produce the wet shoe at the toe of the borehole 12. For example, excess displacement fluid D can be pumped ahead of the wiper plug 40 and can be pumped down through the tool 30 and out of the toe to create a wet shoe condition.

Eventually, as shown in FIG. 1B, the wiper plug 40 reaches a landing sleeve or insert 32 in the wet shoe tool 30, and a portion or head 42 of the wiper plug 40 engages with a seat 34 of the insert 32. The seat 34 can be a landing, shoulder, or the like. The wiper plug 40 engaged with the seat 34 of the insert 32 then prevents fluid communication through the flow bore of the tool 30.

A first application of pressure is applied behind the seated plug 40, and a releasable connection of the insert 32 to the tool 30 releases the insert 32 with the engaged wiper plug 40 to move in the tool 30. The pressure applied behind the wiper plug 40 thereby activates the wet shoe tool 30 by shifting the landing insert 32 free of the releasable connection so the insert 32 moves further toward a bypass 35 of the tool 30. The increase and release of pressure from this action monitored at surface can indicate the proper landing of the wiper plug 40 and shearing of the insert 32. Excess displacement fluid D can be pumped after the wiper plug 40 once it has shifted the insert 32 at least partially open so the fluid can be pumped down through the shoe track and out of the toe to help further create a wet shoe condition.

Eventually as shown in FIG. 1B, the wiper plug 40 and the insert 32 are displaced to the point where a collar 50 disposed on the wiper plug 40 engages with a second or upper seat 36 of the wet shoe tool 30. The collar 50 can be a ring, shoulder, or the like disposed on or about a portion of the wiper plug 40. This second seat 36 can be a landing, collar, shoulder, or the like disposed uphole of the insert 32 with its seat 34. At this stage, before the cement is set, a high-pressure casing integrity test is then performed once the collar 50 on the wiper plug 40 engages in the seat 36 of the tool 30. This test can be performed before (or at least during) the creation of the "wet shoe" condition. In the end, hydraulic access out the toe shoe 17 into the formation can be achieved after the high-pressure casing integrity test.

In particular, the collar 50 disposed on the wiper plug 40 is configured to engage with the second seat 36 and to prevent fluid communication from passing further downhole. As noted, the tubing 16 must withstand pressures during use for which the tubing 16 is designed. Therefore, a second application of applied pressure up to a test pressure level is pumped against seated plug 40 having the collar 50 engaged with the seat 36, which isolates fluid from passing to the downhole end of the tool 30. This allows operators to test the tubing 16 in the borehole 12 up to the test pressure level before the cement has set up in the annulus 14. This test pressure level is above the pressure level used to shear the insert 32 free inside the wet shoe tool 30.

The collar 50 is subsequently removable after the tubing pressure test has been performed. For example, the collar 50 can be self-removing, may dissolve away, or may be otherwise removed. With the collar 50 removed, the wiper plug 40 as shown in FIG. 1C is released from the second seat 36. The insert 32 and the engaged wiper plug 40 are thereby able to move to a downhole position in the bypass 35 of the tool 30. Fluid can now communicate in the bypass 35 of the tool 30 past the insert 32 and the plug 40 and can flow out the toe shoe 17.

At this point, fluid communication is established through the wet shoe tool 30. Displacement fluid D can now pass through the wet shoe tool 30 and out the wet shoe assembly 10 via the bypass 35 to create a wet shoe track 15, which may have benefits in some implementations disclosed herein. In particular, fluid communication is now established through the tubing 16 so additional operations can be performed without requiring tubing-conveyed perforating to be performed in the casing to open of flow path. For example, wireline perforating guns and composite plugs can be pumped down to begin stimulation operations. If desired, the first stimulation operation can be performed through the wet shoe tool 30. The established fluid communication also allows operators to pump fluid out the wet shoe track 15 without the need for an initial drill-out step to be performed. The wet shoe track 15 can be pumped clean of cement, and the float equipment of the toe shoe 17 can remain functional.

Being self-removing, the collar 50 can be composed of a self-removable material that dissolves, disintegrates, or otherwise removes in time to establish flow through the tubing's bore 18 so subsequent operations can be performed. Reference herein to a self-removable material is meant to encompass any materials designed to dissolve, erode, disintegrate, or otherwise degrade over time and/or in certain wellbore conditions due to heat, temperature, hydrocarbon composition, introduced solvent, applied acid, or other factors. For example, the collar 50 can be composed of a dissolvable, degradable, disintegrable, or other self-removable material known in the art when subjected to appropriate conditions, such as a temperature for a period of time, an introduced acid or other fluid, the existing wellbore fluid, etc. For example, the material of the collar 50 can be aluminum, a reactive metal, a magnesium alloy, a degradable composite polymer, a polystyrene, an elastomer, a resin, an adhesive, a polyester, a polyamide, a thermoplastic polymer, a polyglycolide, a polyglycolic acid, a thermosetting polymer, or the like, such as used for fracture balls.

After the wet shoe track 15 is created and flow has been established, another optional pressure integrity test of the tubing 16 can be performed using a self-removing plug 38 landed in the second seat 36 of the wet shoe tool 30. As shown in FIG. 1C, the second seat 36 of the tool 30 can receive another plug 38 deployed down the tubing 16. The seated plug 38 now enables an optional pressure test to be performed on the tubing 16 after the cement has set.

To do the test, the plug 38, such as a ball, is pumped down the tubing 16 to the wet shoe tool 30 and lands in the seat 36 in the tool 30 so the seat 36 and the plug 38 can isolate the tubing 16 above the wet shoe tool 30. Pressure applied against the seated plug 38 can then be used to test the integrity of the cemented tubing 16 to desired test levels.

The additional plug 38 is also self-removing and will then dissolve away or otherwise be removed. Once the plug 38 is removed, fluid communication is re-established through the wet shoe tool 30, allowing for the pump down of perforating guns, composite plugs, and the like for other operations to be performed. Being self-removing, the plug 38 is composed of a self-removable material that dissolves, disintegrates, or otherwise removes in time to re-establish flow through the tubing's bore 18 so subsequent operations can be performed.

Figure 2A:
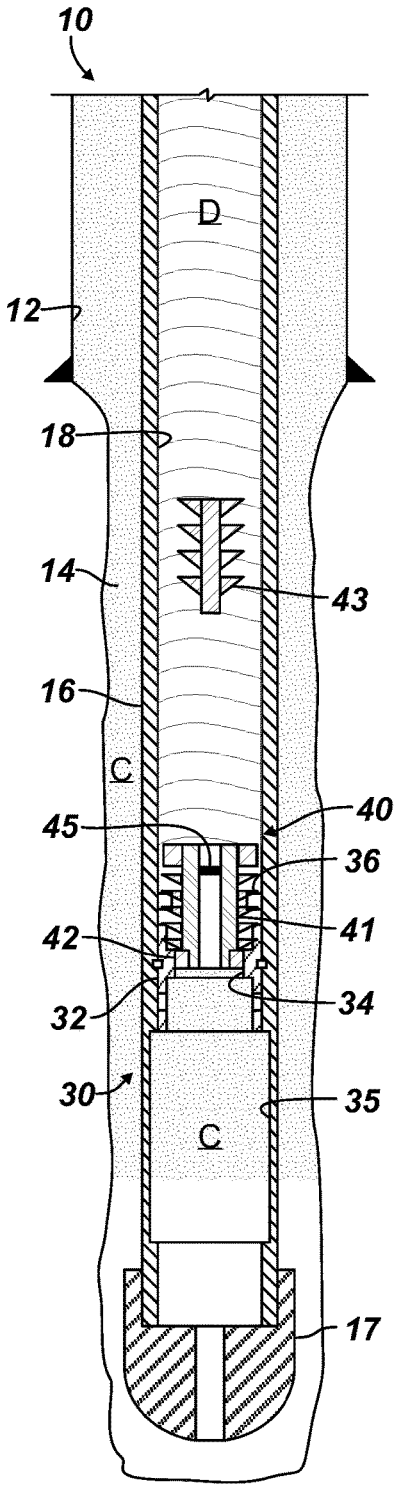
FIGS. 2A-2C illustrate another wet shoe assembly during steps of a cementing procedure according to the present disclosure.
Figure 2B:
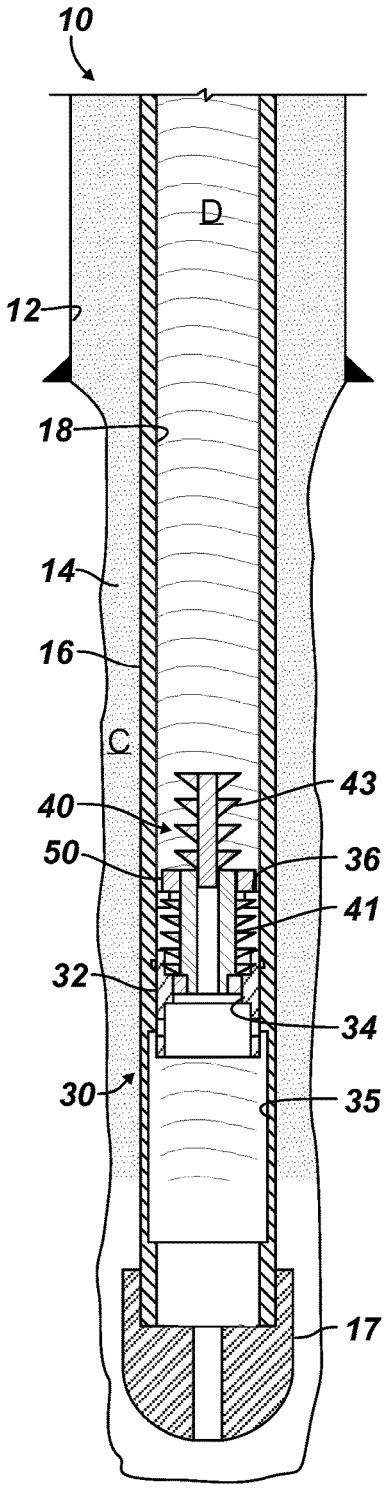
Figure 2C:
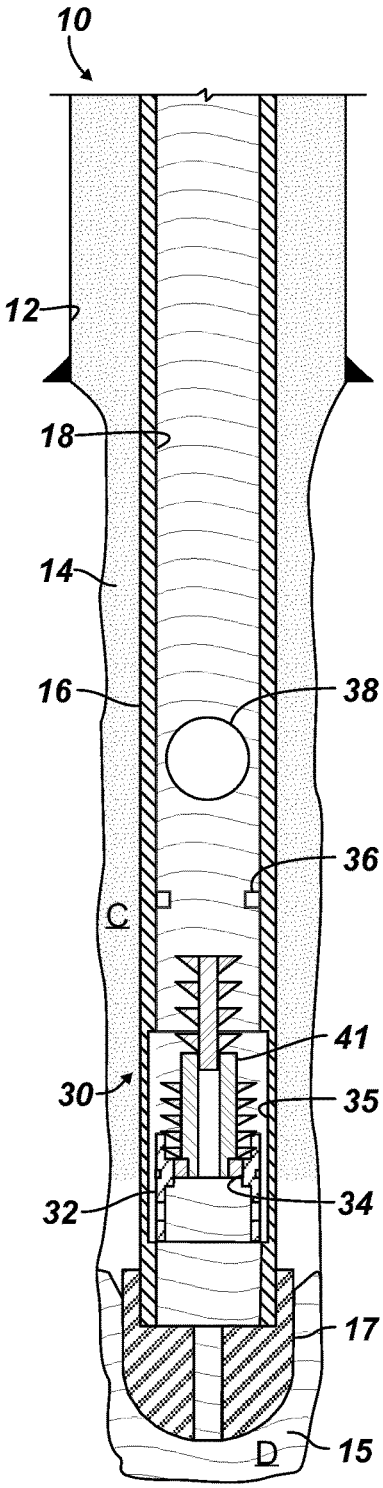

FIGS. 2A-2C illustrate another wet shoe assembly 10 during steps of a cementing procedure according to the present disclosure. This assembly 10 has similarities to the assembly described previously so that like reference numerals are used for comparable components. As shown herein FIG. 2A, the wiper plug 40 includes a bottom plug member 41 and a top plug member 43. The bottom plug member 41 is launched from a cementing head in advance of the cement C and displaces fluids through the tubing 16 while preventing cement contamination.

The bottom plug member 41 is pumped until it lands in the landing insert 32 of the wet shoe tool 30. A passage through the bottom plug member 41 has a closure 45, which can then be opened by pressure. For example, the closure 45 can be a breachable element, such as a rupture disc, or can be a valve or the like. When the closure 45 is opened, the cement C pumped down through the tubing bore 18 of the tubing 16 can now pass through the bottom plug member 41, out the toe shoe 17, and into the annulus 14 of the borehole 12.

Eventually, the top plug member 43 is launched and is pumped down the tubing bore 18 behind the cement C using a displacement fluid D, such as water. The top plug member 43 can be a stinger dart that is pumped behind cement C and wipes the inside of the tubing 16, providing a mechanical barrier between the cement C and the displacement fluid D. Eventually, as shown in FIG. 2B, the top plug member 43 reaches the bottom plug member 41 and closes the fluid passage through the bottom plug member 41. For example, a head of the top plug member 43 can fit into the plug's passage and can latch therein.

At this point, the wet shoe tool 30 and the wiper plug 40 of the wet shoe assembly 10 can operate in a manner comparable to that disclosed above with respect to the wet shoe assembly 10 in FIGS. 1B-1C. Therefore, the related details are briefly repeated here, but they are incorporated by reference. As shown in FIG. 2B, pressure applied against the plug 40 engaged in the seat 34 of the insert 32 can break the releasable connection and allow the plug 40 and insert 32 to shift in the tool 30. The collar 50 on the plug 40 then engages in the second seat 36 of the tool 30 to close off fluid communication so a pressure integrity test can be performed on the tubing 16.

Eventually as shown in FIG. 2C, the collar 50 is removed, and the plug 40 and insert 32 can shift in the tool 30 to the bypass 35, allowing fluid to bypass through the tool 30, out the toe shoe 17 to produce the wet shoe track 15. Should an additional pressure integrity test be desired, a self-removing plug 38 can be landed on the tool's second seat 36. Once pressure testing is complete and the plug 38 is removed, fluid communication can be re-established so additional operations can be performed.

As disclosed herein, the wet shoe assembly 10 according to the present disclosure can be used with casing, such as in a liner system, to test the pressure integrity of the installation. The wet shoe assembly 10 is also used to produce bypass flow around the wiper plug 40 to create a wet shoe track 15, where unset or no cement is left in a tubing section between a float collar and the toe shoe 17 after the primary cementation is complete. The wet shoe assembly 10 can be used for a number of applications, such as plug-and-perf applications, cementing liners and long strings, horizontal and vertical wells, etc.

As noted previously, the flow path through the wet shoe assembly 10 allows a self-removing collar 50 on the plug 40 to be seated on the seat 36 in the wet shoe tool 30. Pressure applied against the seated plug 40 can then be used to test the integrity of the tubing 16 to desired test levels. As disclosed herein, the collar 50 can be composed of a self-removing material that dissolves, disintegrates, or otherwise removes in time to re-establish flow through the tool's bore so subsequent operations can be performed. Eventually, the collar 50 will be removed (e.g., dissolve over time) so that additional operations (plug and perf, ball drop frac, etc.) can be performed in the tubing 16 uphole of the open wet shoe assembly 10. Once the collar 50 is removed, fluid communication is re-established through the wet shoe tool 30, allowing for the pump down of perforating guns, composite plugs, and the like for other operations to be performed.

With the wet shoe track 15 established, fluid may be supplied through the wet shoe assembly 10 into the borehole 12. In this way, a number of additional operations can be performed. For example, a perforating device may be pumped through the tubing's bore 18 on a wireline to perforate one or more sections of the tubing 16. In another example, a plugging device may be pumped through the tubing's bore 18 on a wireline to seal one or more downhole sections of the tubing 16. In yet another example, a perforating, fracturing, and/or another liner hanging operation may be conducted. The insert 32 can be composed of aluminum or composite material for ease in milling out when the wiper plug 40 is milled out.

Figure 3B:
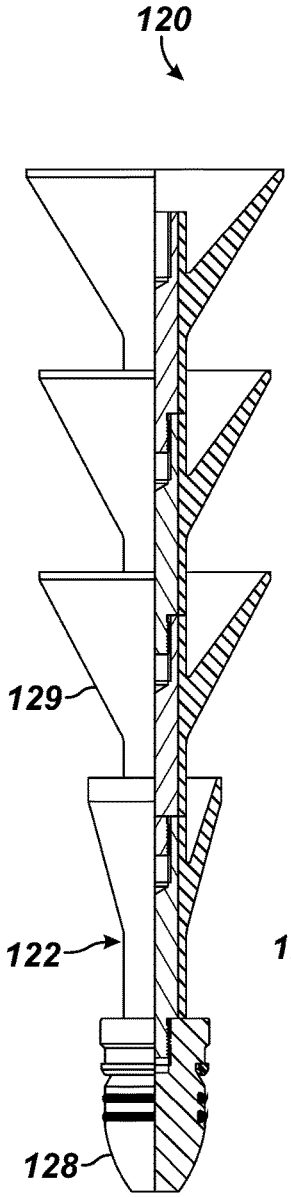
FIGS. 3A-3B illustrate components of a wiper plug in partial cross-section for use in yet another wet shoe assembly of the present disclosure.
Figure 3A:
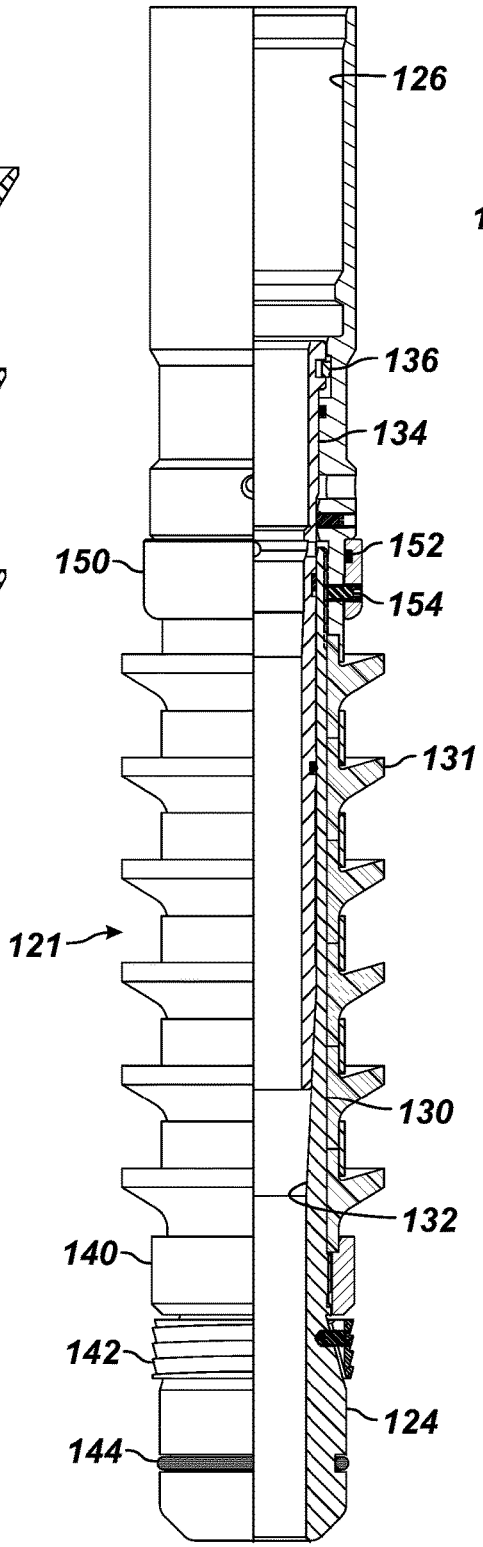
Figure 4:
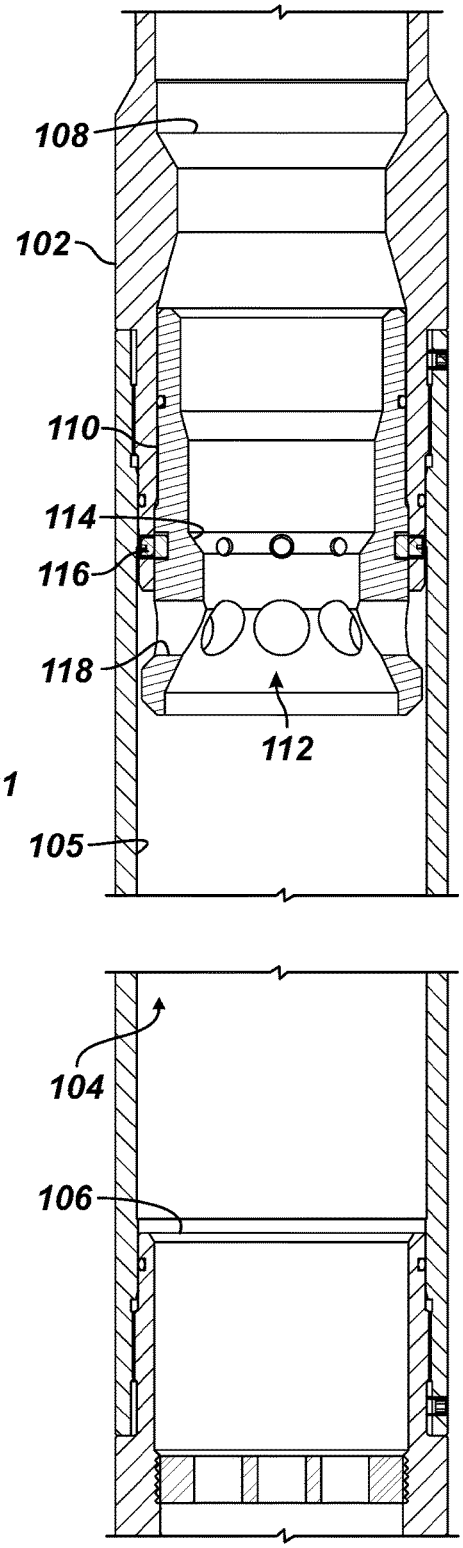
FIG. 4 illustrates a downhole tool in cross-section for use in the wet shoe assembly of the present disclosure.

Turning now to FIGS. 3A-3B and 4, components of another wet shoe assembly of the present disclosure are illustrated in more detail. FIGS. 3A-3B illustrate a wiper plug 120 according to the present disclosure in partial cross-section, and FIG. 4 illustrates a wet shoe tool 102 according to the present disclosure in cross-section.

As shown in FIGS. 3A-3B, the wiper plug 120 in this arrangement includes a first (i.e., bottom) plug member 121 and includes a second (i.e., top) plug member 122. The bottom plug member 121 in FIG. 3A includes a plug body 130 having a first portion, nose, or head 124 at the downhole end configured for engagement. The plug body 130 also has a receptacle 126 at the uphole end. The exterior of the plug body 130 includes fins or wipers 131 for engaging inside tubing through which the wiper plug 120 is passed.

The plug body 130 can define a fluid passage 132 therethrough for fluid therethrough the bottom plug member 121. Depending on the implementation, the fluid passage 132 can include a breachable closure (not shown), such as a rupture disc or the like, to temporarily prevent fluid communication through the fluid passage 132. Likewise, the receptacle 126 at the uphole end can be configured to engage with the top plug member 122, depending on the implementation.

As optionally shown, the fluid passage of the bottom plug member 121 can include various features associated with the release of the bottom plug member 121 during deployment. For example, an internal sleeve 134 can be movable in the fluid passage 132 and locked in place with a lock ring 136. This internal sleeve 134 can be used for locking a collet (not shown) in the receptacle 126 to control the launch of the bottom plug member 121 from a running tool or other launching adapter.

The top plug member 122 in FIG. 3B can be a drillpipe dart and includes a head 128 and wiper fins 129. The head 128 can include seals and a latch ring configured to engage in the bottom plug member 121.

To launch the wiper plug 120 of FIGS. 3A-3B, the bottom plug member 121 is held on a plug adapter on an end of a running tool. Cement can pass through the fluid passage 132 of the bottom plug member 121. To then launch the wiper plug 120 behind the cement, the top plug member 122 in FIG. 3B is released. When the top plug member 122 reaches the bottom member's receptacle 126, the head 128 of the top plug member 122 can engage and seal inside the bottom plug member 121. Differential pressure applied across the wiper plug 120 (i.e., the bottom plug member 121 with the latched top plug member 122) then launches the wiper plug 120 from the plug adapter. The wiper plug 120 is then displaced through the tubing, acting as a mechanical barrier behind the cement. Eventually, the wiper plug 120 lands and latches in a landing collar or seat downhole, and pressure can be applied as required to perform additional operations, as discussed below.

The first portion, nose, or head 124 of the bottom plug member 121 includes a number of features for engaging, sealing, locking, or the like with a landing collar or seat of a downhole insert or sleeve, as discussed previously. These features can include an engagement ring 140, a body lock ring 142, and a seal 144.

Additionally, the plug body 130 of the wiper plug 120 also includes a second portion or a removable collar 150 that is configured to engage and seal with a seat in a wet shoe tool as discussed previously. The collar 150 can be ring-shaped as shown and can be disposed about the plug body 130. An inner seal 152 can seal the collar 150 on the plug body 130, and one or more retainers 154 can affix the collar 150 in place. If desired, the retainer 154 can be a breakable connection, such as a shear pin.

As noted above, the collar 150 can be composed of a self-removing material. Again, for example, the collar 150 can be composed of a self-removable material that dissolves, disintegrates, or otherwise removes in time to establish flow through the tubing's bore so subsequent operations can be performed. Reference herein to a self-removable material is meant to encompass any materials previously described.

The wet shoe tool 102 of the assembly shown in FIG. 4 has a tubular housing that connects to the tubing and other components used in the borehole. The wet shoe tool 102 includes a sleeve or an insert 110 disposed in a bore 104 of the wet shoe tool 102. The insert 110 includes a through-bore or flow passage 112 therethrough, and the flow passage 112 has a seat or landing shoulder 114 for engaging the wiper plug (120). A releasable connection 116, such as shear pins, retains the insert 110 in the tool's bore 104 adjacent a landing shoulder, upper seat, or plug seat 108 of the wet shoe tool 102.

For flow bypass as discussed below, the insert 110 includes cross-ports or side ports 118 in its sides. Additionally, the tool's bore 104 includes a bypass relief or an expanded section 105 uphole of a bottom or landing shoulder 106. This bypass relief 105 can house the wiper plug (120) when the insert 110 is shifted to the landing shoulder 106 and can allow flow to bypass around the housed wiper plug (120).

Figure 5A:
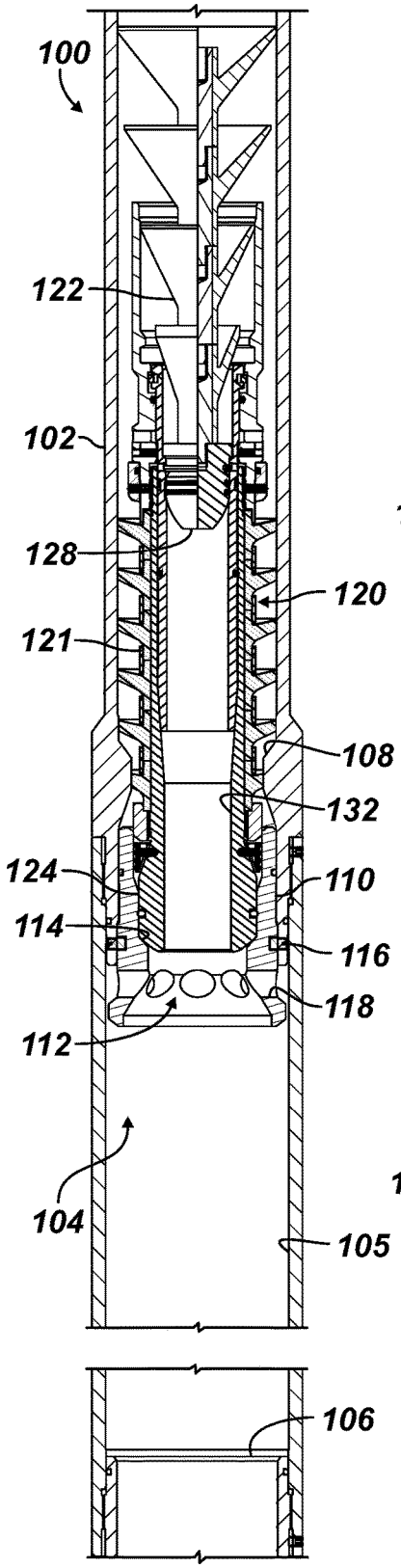
FIGS. 5A-5C illustrate the wet shoe assembly of the present disclosure during stages of operation.
Figure 5B:
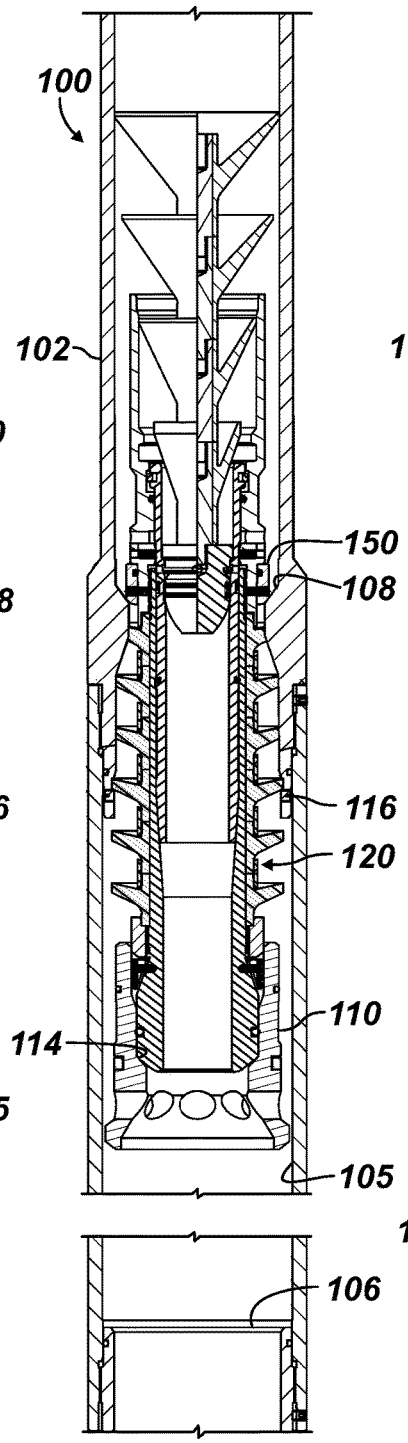
Figure 5C:
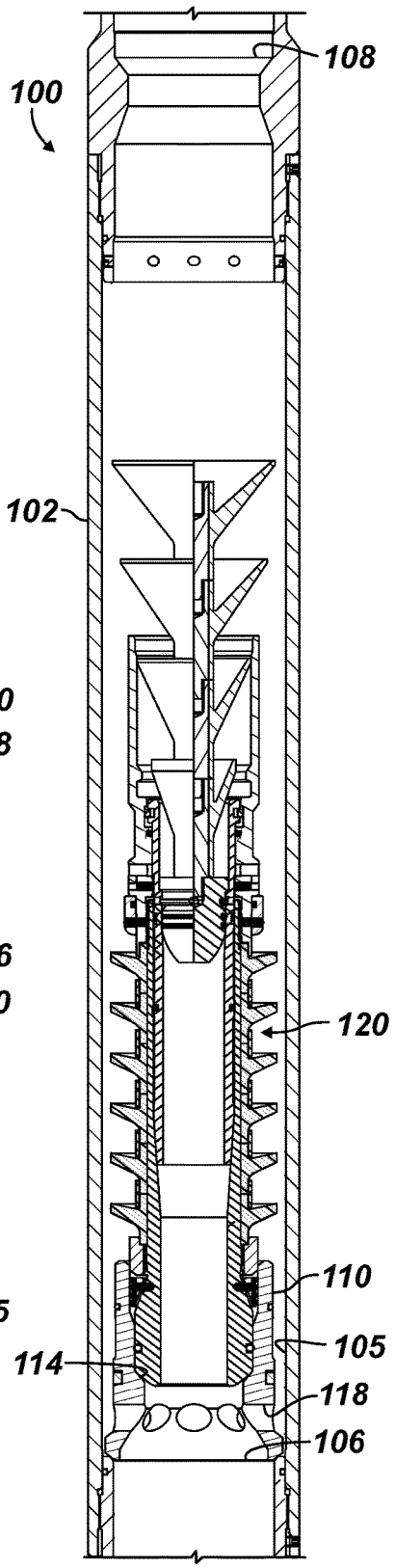

FIGS. 5A-5C illustrate a wet shoe assembly 100 having the above components during stages of operation. Again, the wet shoe assembly 100 includes the wet shoe tool 102 and the wiper plug 120 as discussed above. The wet shoe tool 102 has the bore 104 for flow therethrough, and the bore 104 includes the bypass relief 105 and the landing shoulder 106 at a downhole end. Toward the uphole end, the wet shoe tool 102 includes the plug seat 108. Intermediate the plug seat 108 and the landing shoulder 106, the sleeve or insert 110 is arranged in the bore 104 and is held by the shear pins 116. The insert 110 includes the through-bore or flow passage 112 with the seat or landing shoulder 114, and side ports 118 in the side of the insert 110 communicate the through-bore or flow passage 112 outside the insert 110.

As shown in FIG. 5A, the wiper plug 120 deployed through tubing lands in the landing shoulder 114 of the insert 110. As shown here, the wiper plug 120 includes the bottom plug member 121 and the top plug member 122, and the bottom plug member 120 includes an internal passage 132 in which the top plug member 122 is engaged. Depending on the implementation, the bottom and top plug members 121, 122 of the wiper plug 120 can be pumped down together through the tubing 16 to the bore 104 of the housing of the wet shoe tool 102 behind the pumped cement. This arrangement is similar to that discussed above with reference to FIGS. 1A-1C.

Alternatively, the bottom plug member 121 of the wiper plug 120 can be pumped ahead of the cement (not shown). A closure (not shown), such as a breachable element or a rupture disc, in the fluid passage 132 of the bottom plug member 121 can be breached to permit the cement to flow through the fluid passage 132. For example, cement may be supplied at a pressure sufficient to breach/rupture the closure (not shown) in the bottom plug member 121 and permit fluid flow through the fluid passage 132 into the borehole. A predetermined amount of cement may be supplied into the borehole to cement the tubing therein. Eventually, the top plug member 122 can be pumped behind the cement and can land in the receptacle 126 of the bottom plug member 121 to seal fluid flow. This arrangement is similar to that discussed above with reference to FIGS. 2A-2C.

As shown in FIG. 5A, the wiper plug 120 reaches the insert 110 in the downhole wet shoe tool 102, and the head 124 of the wiper plug 120 engages with the seat 114 of the insert 110. The engagement prevents fluid communication through the bore 104 of the wet shoe tool 102 from the uphole end to the downhole end. On the head 124, the engagement ring (140: FIG. 3A) can engage inside the seat 114, and the seal (144: FIG. 3A) can seal the space between the seat 114 and the head 124. The body lock ring (142: FIG. 3A) can engage in the through-bore of flow passage 112 of the insert 110 to prevent removable of the head 124 from the seat 114.

Pumped fluid against the seated wiper plug 120 can then break the releasable connections or shear pins 116, allowing the insert 110 to shift in the tool's bore 104. For example, fluid may be supplied through the tubing behind the wiper plug 120 at a pressure sufficient to shear the shear pins 116 and shift the insert 110 at least partially toward the bypass relief 105. The pressure readings before and after shearing the shear pins 116 may provide an indication at surface that the insert 110 and the wiper plug 120 are in the desired position, providing a positive indication of cement displacement and wiper plug location. Adjustable shear values for the releasable connection 116 can be used for the insert 110 to provide a clear indication that wiper plug 120 has landed and that shearing events have occurred. In this way, the insert 110 can be configured to shear free with an adjustable and configurable shear value to meet the application at hand.

Eventually as shown in FIG. 5B, the wiper plug 120 and the insert 110 are displaced to the point where the collar 150 disposed on the wiper plug 120 engages with the upper seat 108 of the wet shoe tool 102.

The collar 150 engaged with the upper seat 108 prevents fluid (at least partially) from passing further downhole. This creates a pressure seal that allows operators to perform a casing integrity test up to a desired test pressure level, such as 10,000 psi. Accordingly, fluid pressure can be pumped behind the seated wiper plug 120 to test the tubing in the borehole before the cement has been set up in the annulus. This tubing pressure test can have a number of advantages in testing the installation. For example, the high-pressure casing integrity test can be completed for increased efficiency at the time of the wiper plug 120 bumping against the upper seat 108, before obtaining a wet shoe condition. This process reduces costs and increases efficiency for the operator because this process can eliminate the need to re-enter the wellbore at a later time to deploy a ball or a plug downhole to perform a pressure test.

Once the pressure test is completed, pressure can be bled off, and the collar 150 is subsequently removable within a predetermined amount of time. For example, the collar 150 can degrade, dissolve, disintegrate, etc. over time. As will be appreciated, the time to dissolve is dependent on the material selection, temperature, fluid salinity, and other parameters, which can be configured for an implementation. With the collar 150 removed, the wiper plug 120 as shown in FIG. 5C is released from the upper seat 108. The insert 110 with the engaged wiper plug 120 is thereby able to move to a downhole position in the wet shoe tool 102, which permits fluid communication through the flow bore.

Once the collar 150 is removed and the insert 110 and wiper plug 120 have shifted, fluid communication is established through the wet shoe tool 102. Displacement fluid D can now pass through the wet shoe tool 102 and out the wet shoe assembly 100 via the bypass to create a wet shoe track, which may have benefits in some implementations disclosed herein. As shown in FIG. 5C, for example, the wet shoe assembly 100 is shown open once fluid flow is established to form a wet shoe. The insert 110 lands on the landing shoulder 106, and the wiper fins 131 of the wiper plug 120 are spaced from the bypass relief 105.

Fluid may now flow around the wiper plug 120 and pass to the bypass relief 105. The side ports 118 in the insert 110 can communicate the flow from the bypass relief 105 to the downhole end of the bore 104. This fluid communication allows for a wet shoe track to be created so additional operations can be performed as disclosed herein. The reduction in pressure and/or the circulation of fluid flow through the bypass relief 105 into the borehole can provide another indication at the surface of the position of the wiper plug 120 and the insert 110 and can indicate that fluid communication through the wet shoe assembly 100 is open to conduct subsequent operations.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. An assembly for cementing tubing in a wellbore with cement and for testing the tubing with applied pressure, the assembly comprising:

a tool disposed on the tubing and defining a flow bore, the flow bore having an uphole seat;

an insert disposed in the flow bore and having a downhole seat;

a plug body having a downhole end and an uphole end and having one or more wipers disposed thereabout;

a first portion of the plug body disposed toward the downhole end of the plug body, the first portion being configured to pass through the uphole seat in the tool and being configured to engage with the downhole seat in the insert, the first portion engaged with the downhole seat being configured to prevent communication of the applied pressure through the downhole seat, the insert and the plug body being movable at least from a first position toward a second position in the flow bore in response to the applied pressure; and a second portion of the plug body disposed toward the uphole end of the plug body, the second portion being configured to engage with the uphole seat in the tool in response to the movement of the insert and the plug body toward the second position in the flow bore, the second portion engaged with the uphole seat being configured to prevent communication of the applied pressure through the uphole seat, the second portion being removable from the plug body, the plug body and the insert, upon removal of the second portion of the plug body, being releasable from the uphole seat and being configured to permit fluid communication through the uphole seat and along the flow bore past the insert and the plug body.

2. The assembly of claim 1, wherein the insert is held in the flow bore by a releasable connection, the releasable connection of the insert being releasable in response the applied pressure, the insert being movable from the first position toward the second position in response to the release of the releasable connection.

3. The assembly of claim 1, wherein:

the flow bore of the tool defines a relief therein; and the plug body and the insert moved toward the second position are disposed adjacent to the relief and are configured to permit the fluid communication in a space between the insert and the relief.

4. The assembly of claim 1, wherein:

the first portion of the plug body comprises a head disposed on the plug body and being configured to seal and engage in a receptacle of the downhole seat of the insert; and the second portion of the plug body comprises a collar disposed on the plug body and being configured to engage with the second seat in response to the movement of the insert from the first position, the collar engaged with the second seat being configured to prevent a subsequent application of the applied pressure through the flow bore, the collar being removable at least after the subsequent application, the plug body upon removal of the collar being configured to release from the second seat.

5. The assembly of claim 1, wherein:

the plug body comprises a bottom member and a top member, the bottom member having a passage therethrough, the passage having a closure closing the passage, the bottom member being deployable down the tubing ahead of the cement, the bottom member having the first portion of the plug body being configured to engage with the downhole seat of the insert, the closure of the bottom member being opened in response to an initial application of the applied pressure against the engaged bottom member, the top member being configured to engage with the passage of the bottom member and being configured to close fluid communication through the passage in the bottom member; and the second portion of the plug body comprises a collar disposed on the bottom member and being configured to engage with the second seat in response to the movement of the insert from the first position, the collar engaged with the second seat being configured to at least restrict a subsequent application of the applied pressure through the flow bore, the collar being removable at least after the subsequent application, the bottom member upon removal of the collar being configured to release from the second seat.

6. The assembly of claim 1, wherein the insert comprises a sleeve disposed in the flow bore, the sleeve having a fluid passage therethrough with the downhole seat formed therein, the sleeve defining a bypass port communicating the fluid passage downhole of the downhole seat outside the sleeve.

7. An assembly for cementing tubing in a wellbore with cement and for testing the tubing with applied pressure, the assembly comprising:

a tool disposed on the tubing and having an uphole end and a downhole end, the tool defining a flow bore therethrough;

an insert disposed in the flow bore and having a first seat, the insert being held in a first position by a releasable connection to the tool and being movable in the flow bore from the first position in response to release of the releasable connection;

a second seat disposed in the flow bore of the tool uphole of the insert;

a wiper plug deployable down the tubing, a portion of the wiper plug being configured to pass through the second seat and being configured to engage with the first seat of the insert, the wiper plug engaged with the first seat of the insert in the first position being configured to prevent a first application of the applied pressure through the flow bore, the insert with the engaged wiper plug being movable from the first position in response to the first application of the applied pressure releasing the releasable connection; and a collar disposed on the wiper plug and being configured to engage with the second seat in response to the movement of the insert from the first position, the collar engaged with the second seat being configured to prevent a subsequent application of the applied pressure through the flow bore, the collar being removable at least after the subsequent application, the wiper plug upon removal of the collar being configured to release from the second seat, the insert with the engaged wiper plug being movable to a second position configured to permit fluid communication through the flow bore of the tool past the insert and the wiper plug.

8. The assembly of claim 7, further comprising another plug being deployable down the tubing behind the wiper plug and being configured to engage with the wiper plug.

9. The assembly of claim 7, wherein the wiper plug comprises:

a bottom member having a passage therethrough, the passage having a closure closing the passage, the bottom member being deployable down the tubing ahead of the cement and being configured to engage with the first seat of the insert, the closure of the bottom member being opened in response to an initial application of the applied pressure against the engaged bottom member before the first application; and a top member being configured to engage with the passage of the bottom member and being configured to close fluid communication through the passage in the bottom member.

10. The assembly of claim 9, wherein the passage of the bottom member defines a receptacle; and wherein the top member comprises a drillpipe dart having a head, the head configured to engage with the receptacle of the bottom member.

11. The assembly of claim 7, wherein the insert comprises a sleeve disposed in the flow bore, the sleeve having a fluid passage therethrough with the first seat formed therein, the sleeve defining a bypass port communicating the fluid passage downhole of the first seat outside the sleeve.

12. The assembly of claim 7, wherein the flow bore of the tool defines a relief therein, the insert in the second position being disposed adjacent to the relief and being configured to permit the fluid communication in a space between the insert and the relief.

13. The assembly of claim 12, wherein the relief of the tool defines a shoulder toward the downhole end of the tool, the shoulder engaging the insert in the second position.

14. The assembly of claim 7, wherein the collar comprises a self-removable material selected from the group consisting of a dissolvable material, an erodible material, a disintegrable material, a degradable material, an aluminum, a reactive metal, a magnesium alloy, a degradable composite polymer, a polystyrene, an elastomer, a resin, an adhesive, a polyester, a polyamide, a thermoplastic polymer, a polyglycolide, a polyglycolic acid, and a thermosetting polymer.

15. The assembly of claim 7, wherein the releasable connection comprises one or more shear pins disposed between the insert and the flow bore of the tool.

16. A method, comprising:

cementing tubing in a borehole by: (i) pumping cement down a flow bore of the tubing, (ii) deploying a wiper plug down the flow bore at least behind a portion of the cement, and (iii) seating the wiper plug on a first seat disposed in a first position in the flow bore of the tubing;

moving the first seat and the wiper plug from the first position toward a second position in the flow bore with a first application of pressure down the flow bore against the seated wiper plug;

pressure testing the tubing by: (i) seating a collar disposed on the wiper plug on a second seat disposed in the flow bore uphole of the first seat, (ii) applying a second application of pressure down the flow bore, and (iii) preventing the second application of pressure through the flow bore downhole of the collar seated in the second seat; and establishing fluid communication through the flow bore downhole of the wiper plug, the first seat, and the second seat by removing the collar from the wiper plug, releasing the first seat and the wiper plug to move to the second position in the flow bore, and bypassing the fluid communication through the flow bore around the wiper plug seated in the first seat moved to the second position.

17. The method of claim 16, further comprising pressure testing the cemented tubing by: (i) seating a second plug in the second seat in the flow bore uphole of the first seat, (ii) subjecting the cemented tubing to a third application of pressure against the seated second plug, and (ii) reestablishing fluid communication through the flow bore of the tubing by self-removing the second plug from the second seat.

18. The method of claim 16, wherein cementing the tubing in the borehole comprises:

seating a bottom member of the wiper plug ahead of the cement on the first seat;

breaching a flow passage through the bottom member;

passing the cement through the flow passage; and seating a top member of the wiper plug behind the cement in the flow passage of the bottom member.

19. The method of claim 16, wherein moving the first seat from the first position toward the second position in the flow bore with the first application of pressure against the seated wiper plug comprises releasing a temporary connection retaining the first seat in the first position inside the flow bore with the first application of pressure against the seated wiper plug.

20. The method of claim 16, wherein moving the first seat from the first position toward the second position in the flow bore with the first application of pressure against the seated wiper plug comprises shifting an insert having the first seat from the first position toward a relief of the flow bore in the second position.

21. The method of claim 20, wherein establishing the fluid communication through the flow bore downhole of the wiper plug, the first seat, and the second seat comprises bypassing the fluid communication from the relief of the flow bore through a side port defined in the insert downhole of the first seat.

22. The method of claim 16, comprising establishing a wet shoe track downhole of the first seat.

* * * * *